United States Patent [19]

Finch

[11] Patent Number: 4,875,290

[45] Date of Patent: Oct. 24, 1989

[54] WINDAGE LOCKING APPARATUS FOR AN ARCHERY BOW SIGHT

[75] Inventor: Jack A. Finch, Broken Arrow, Okla.

[73] Assignee: ACCRA Manufacturing Co., Broken Arrow, Okla.

[21] Appl. No.: 226,945

[22] Filed: Aug. 1, 1988

[51] Int. Cl.[4] ..... F41G 1/46

[52] U.S. Cl. ..... 33/265; 33/252

[58] Field of Search ..... 33/265, 252; 124/87

[56] References Cited

U.S. PATENT DOCUMENTS

| | | | |
|---|---|---|---|
| 2,351,103 | 6/1944 | Brown | 33/265 |
| 2,875,522 | 3/1959 | Merrill et al. | 33/265 |
| 2,900,973 | 8/1959 | Diehr | 33/265 |
| 3,084,442 | 4/1963 | Jacobson et al. | 33/265 |
| 3,284,904 | 11/1966 | Rade | 33/265 |
| 3,355,809 | 12/1967 | Guyton | 33/265 |
| 3,477,130 | 11/1969 | Egan | 33/265 |
| 3,526,037 | 9/1970 | Crosby | 33/265 |
| 3,787,984 | 1/1974 | Bear et al. | 33/265 |
| 3,854,217 | 12/1974 | Killian | 33/265 |
| 4,020,560 | 5/1977 | Heck | 33/265 |
| 4,457,076 | 7/1984 | Heck | 33/265 |
| 4,567,668 | 2/1986 | King | 33/265 |

OTHER PUBLICATIONS

Cover and p. 1 of ACCRA 300 catalog for 1988.

*Primary Examiner*—William A. Cuchlinski, Jr.
*Assistant Examiner*—Thomas B. Will
*Attorney, Agent, or Firm*—W. Scott Carson

[57] ABSTRACT

Windage locking apparatus for an archery bow sight. The apparatus includes aperture, barrel, and body members concentrically positioned within each other about an axis and common locking structure to selectively lock these member together to prevent relative movement among them about and along the axis. The common structure includes a single set screw extending outwardly of the axis through the barrel and body members and a locking knob to fit on the portion of the set screw protruding outwardly of the body member. In operation and with the set screw securely holding the aperture and barrel members together, the locking knob can be tightened on the protruding portion of the set screw to draw the barrel member into frictional contact with the surrounding body member to lock the aperture, barrel, and body members securely in place for shooting. Additionally, the present invention provides structure to keep the locking knob from being separated from the set screw and possibly becoming lost.

19 Claims, 6 Drawing Sheets

1
3
5
7
9
11
15
25
13
17
19
21
23
31
2

Fig. 4
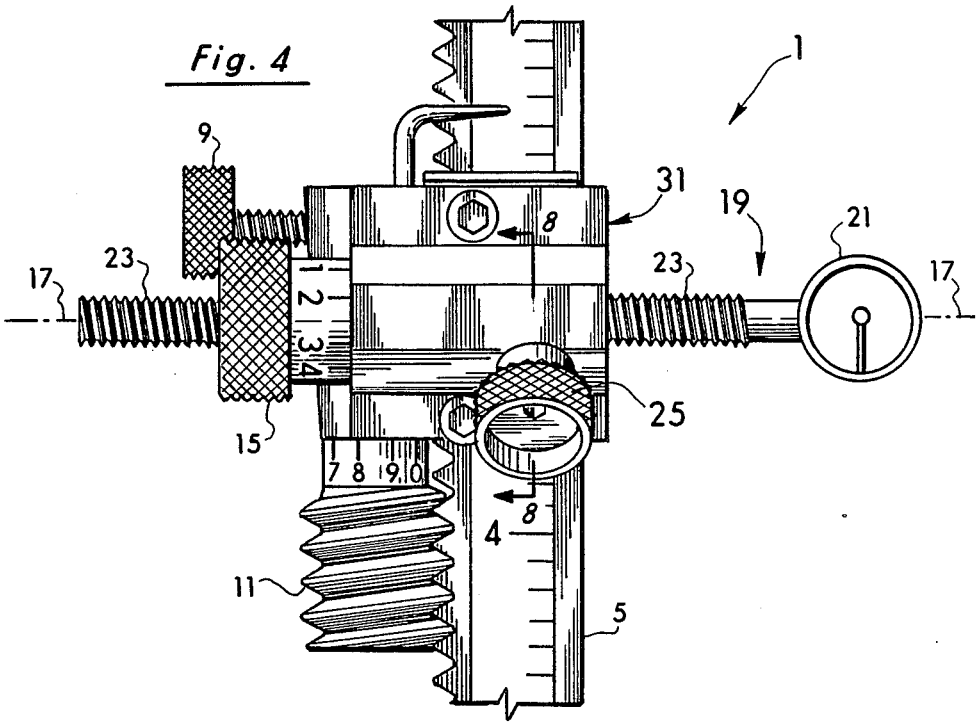
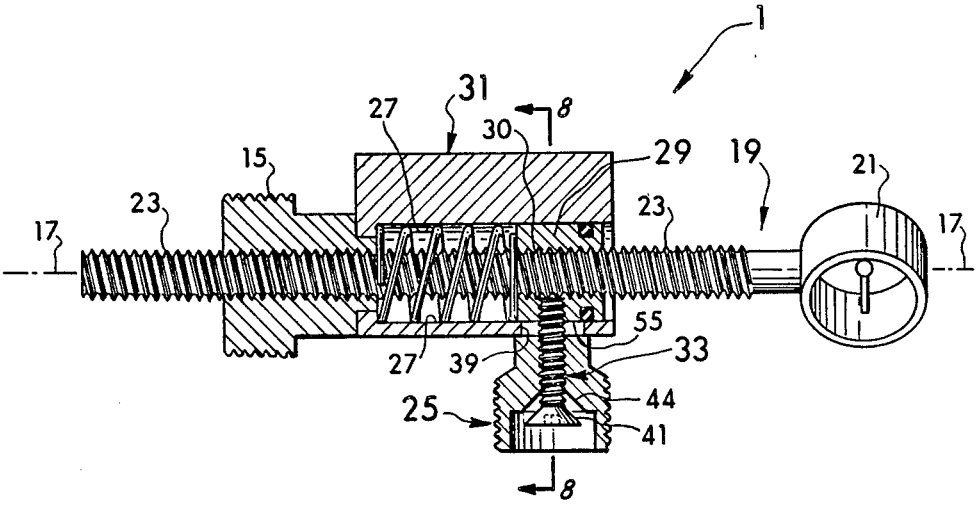
Fig. 5

Fig. 6
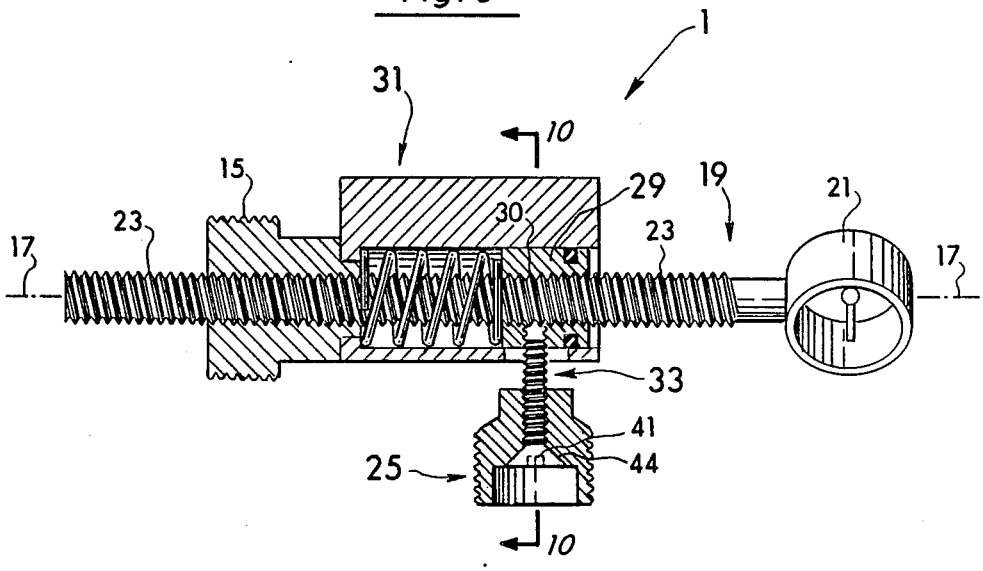
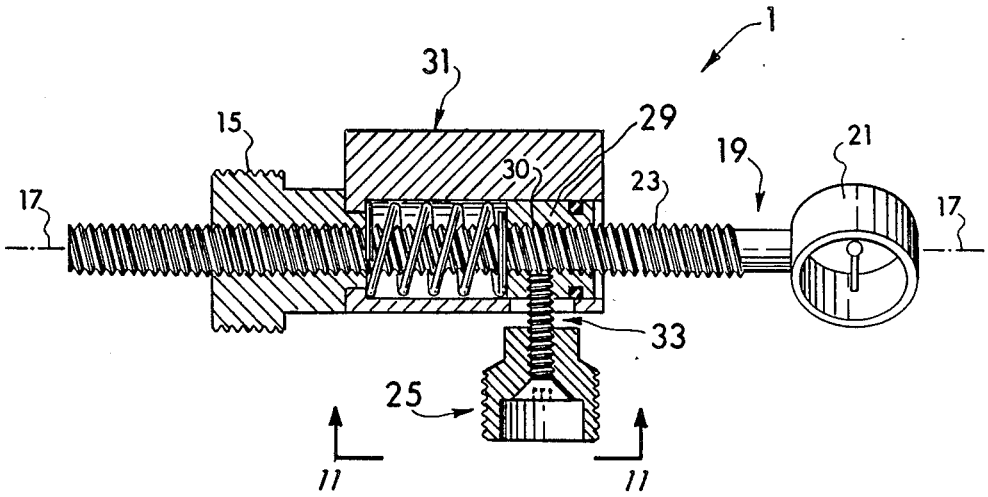
Fig. 7

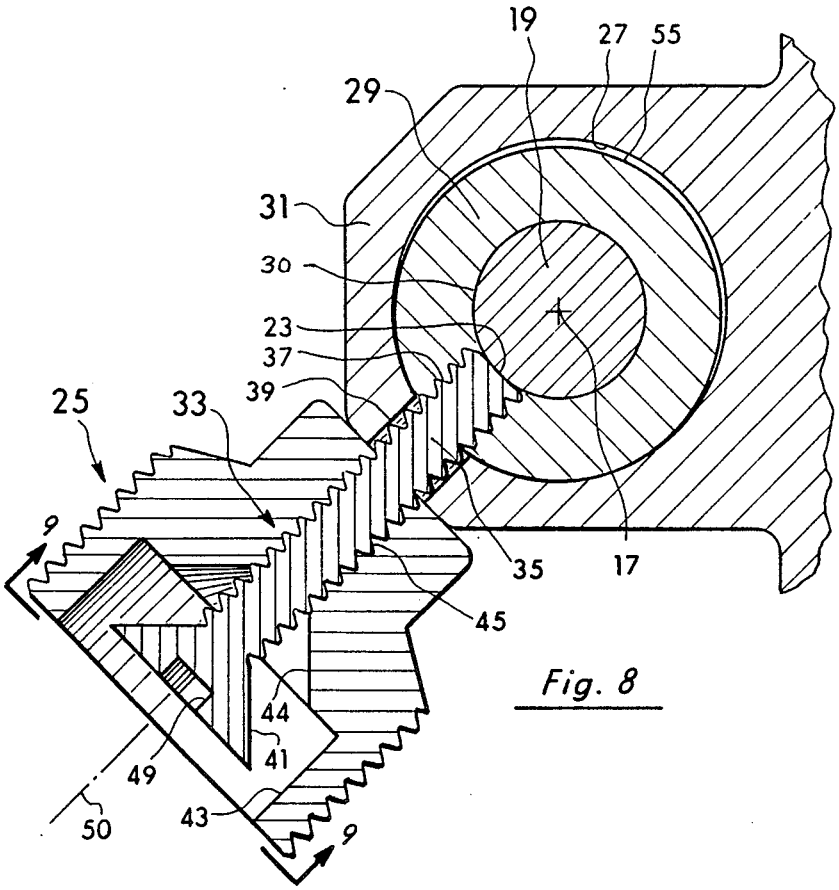
Fig. 8
Fig. 9
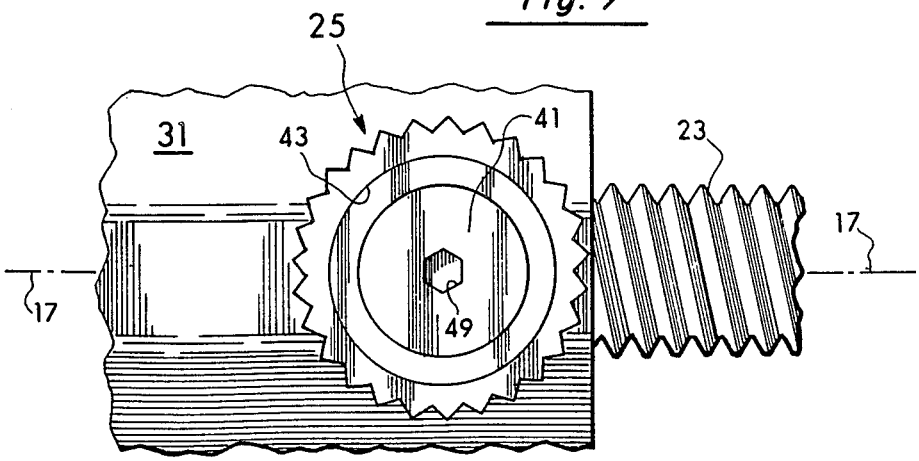

WINDAGE LOCKING APPARATUS FOR AN ARCHERY BOW SIGHT

BACKGROUND OF THE INVENTION

1. Field of the Invention

This invention relates to the field of archery bow sights and more particularly to the field of windage locking devices for archery bow sights.

2. Discussion of the Background

Archery bow sights have become very sophisticated as evidenced by the sights of U.S. Pat. Nos. 4,564,688 to King; 4,457,076 to Heck; 3,854,217 to Killian; 3,355,809 to Guyton; and 3,284,904 to Rade. Common among these sights is the ability to adjust the various elements of the sight relative to each other and to the bow for improved accuracy.

In such sights as typified by U.S. Pat. No. 3,854,217 to Killian in his FIGS. 3, 5, and 8, structure is provided to adjust the sighting aperture horizontally left and right to allow for windage across the shooting field. In the case of Killian, this is accomplished by selectively turning the windage adjustment knob 100 (see his FIG. 5) which then moves the threaded portion (98) of his aperture member (98, 110, 112, 116) horizontally left or right relative to the sight body member (50) which in turn is fastened to the bow. In Killian, the sighting aperture (116) is then held in the desired place by a resilient O-ring (104). However, in some applications such as with compound bows, the vibration from using the bow is such that the simple O-ring (104) of Killian is no longer adequate to prevent the loosening of the windage adjustment knob (100) and the subsequent moving of the sighting aperture (116) away from the desired position.

Several approaches have been attempted to overcome this problem. In one approach, an additional jam nut is placed following the windage adjustment knob. However, this approach requires the archer to hold the windage adjustment knob with one hand while tightening the jam nut with the other. In doing so, the archer must then lay his bow down while he manipulates the knobs. A second approach involves using detents but even this at times has failed. A third approach involves extending the guide shoulder (102) in Killian's U.S. Pat. No. 3,854,217 farther into the body (50) and then adding a locking screw to pass through the body (50) and impinge against the extended guide shoulder.

This last approach has been commercially produced but it has several drawbacks. Notably, the locking screw passes through the sight body in a relatively thin area. Consequently, on occasion, the tightening of the screw can rip out the threads in the body because the area is so thin. Also, the screw abuts against the windage adjustment knob with the relatively small end of the screw and this is often not enough to securely hold a lock under certain vibrations. Additionally, once the screw in this prior approach is loosened either unintentionally by vibration or intentionally by the archer while he makes a windage adjustment, it often becomes completely unscrewed falling off the sight itself and becoming lost.

In contrast to these prior approaches, the windage lock apparatus of the present invention involves a unique arrangement which not only securely locks the sighting aperture in place but also provides easy operation and access to the archer. Additionally, the windage locking device of the present invention provides structure which prevents the locking knob from being separated from the sight itself and possibly becoming lost.

SUMMARY OF THE INVENTION

This invention involves windage locking apparatus for an archery bow sight which allows the archer to easily and conveniently make gross and fine windage adjustments of the sighting aperture and then lock the aperture securely in place. The apparatus includes aperture, barrel, and body members concentrically positioned within each other about an axis. Common locking structure is then provided to selectively lock these member together to prevent relative movement among them about and along the axis. The common structure includes a single set screw extending outwardly of the axis through the barrel member to prevent movement of the aperture member relative to the surrounding barrel member. This same set screw also extends through and protrudes outwardly of the body member wherein a locking knob is provided to fit on the protruding portion. In operation and with the set screw securely holding the aperture and barrel members together, the locking knob can be tightened on the protruding portion of the set screw to draw the barrel member into frictional contact with the surrounding body member. This in turn, locks the aperture, barrel, and body members securely in place. The present invention also provides for convenient gross adjustment of the aperture within the barrel by providing easy access to the socket end of the set screw through the head of the locking knob. Additionally, the present invention provides structure to keep the locking knob from being separated from the set screw and possibly becoming lost.

BRIEF DESCRIPTION OF THE DRAWINGS

FIG. 4 is a front view of portions of the sight.

FIG. 5 is a cross-sectional view of the sight taken along line 5—5 of FIG. 2 showing the windage locking apparatus of the present invention in its locked position.

FIG. 6 is a view similar to FIG. 5 illustrating the windage locking apparatus in a loosened position in which the aperture member can be grossly adjusted.

FIG. 7 is a view similar to FIGS. 5 and 6 showing the windage locking apparatus in a position in which the aperture member can be finely adjusted.

FIG. 8 is a cross-sectional view taken along lines 8—8 of FIGS. 4 and 5.

FIG. 9 is a view taken along line 9—9 of FIG. 8.

DETAILED DESCRIPTION OF THE PREFERRED EMBODIMENTS

Figures 1, 2, 3:
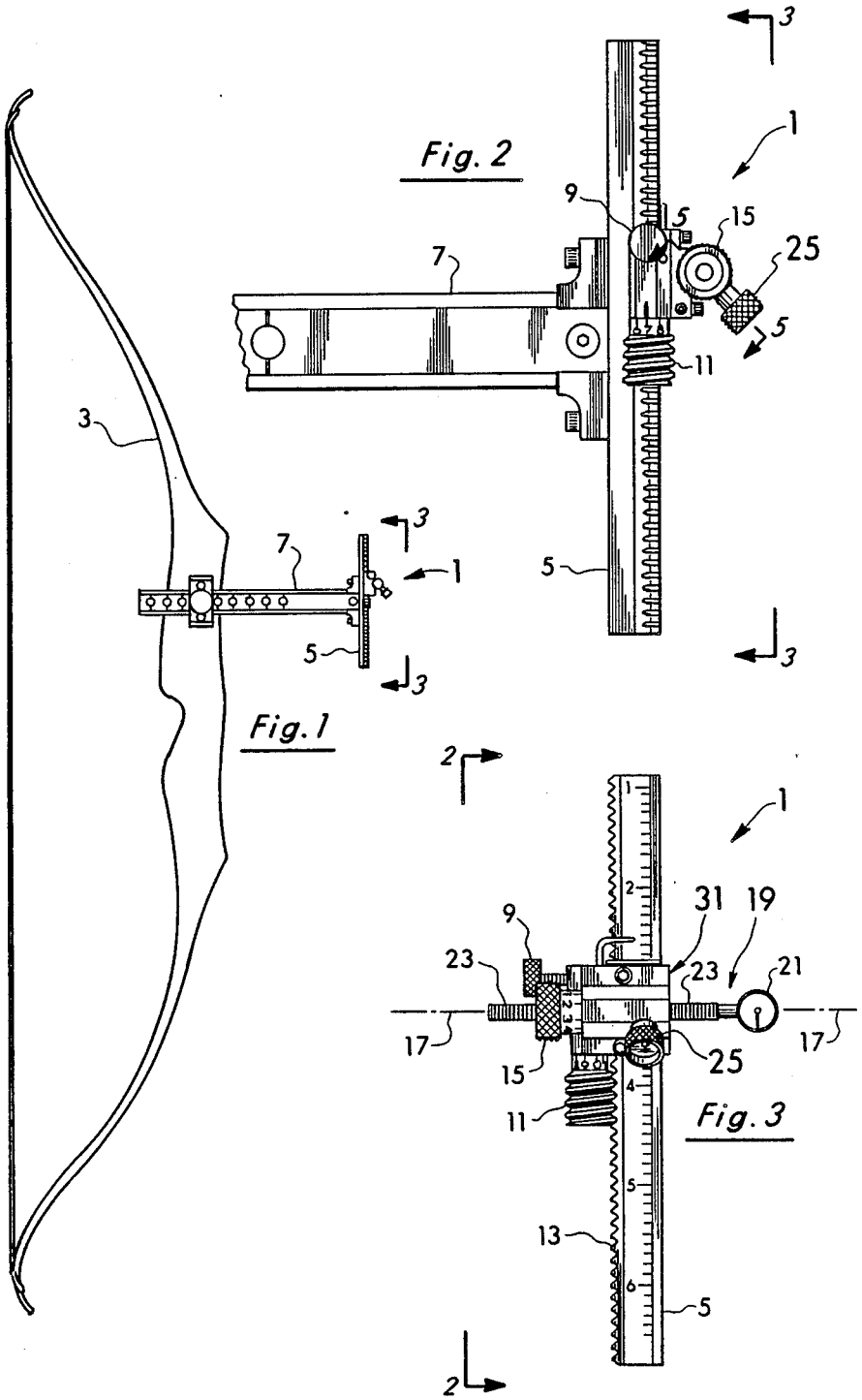
FIG. 1 is a side view of the sight of the present invention mounted on an archery bow.
FIG. 2 is an enlarged, side view of the sight taken along line 2—2 of FIG. 3.
FIG. 3 is a front view of the sight taken along line 3—3 of FIGS. 1 and 2.

As shown in FIGS. 1-3, the archery sight 1 of the present invention can be secured to the bow 3 in any known and conventional manner such as the illustrated arrangement of the sight bar 5 and extension bar 7 (see FIG. 1). In such an arrangement, the sight 1 can be vertically positioned as desired along the sight bar 5 (see FIGS. 2 and 3) by manipulating the knob 9 (see FIG. 3) to permit the pivotally mounted worm gear 11 in a known manner to be disengaged from the notches 13 of the sight bar 5. Sight 1 can then be freely moved as desired up or down on the sight bar 5 and the worm gear 11 subsequently re-engaged with the notches 13. Fine elevational adjustments can thereafter be made by selectively rotating the engaged worm gear or micrometer 11 to move the sight 1 vertically along the sight bar 5.

The windage locking apparatus of the present invention (see FIGS. 4 and 5) primarily involves the aperture member 19 (with its sighting portion 21 and elongated threaded portion 23) and the surrounding barrel and body members 29 and 31 (see FIG. 5). As shown, the barrel and body members 29 and 31 are concentrically positioned about the elongated threaded portion 23 and about the axis 17. The present invention also involves the positioning and operation of the set screw 33 and locking knob 25 as explained in more detail below.

Beginning with the aperture member 19 (see FIGS. 4 and 5), this member has a sighting portion 21 and an elongated threaded portion 23. As illustrated in FIGS. 4 and 5, the elongated threaded portion 23 of the aperture member 19 extends away from the sighting portion 21 along the axis 17. The elongated threaded portion 23 (see FIG. 5) in turn extends through the bore 27 in the body member 31 and is threadedly received in the barrel member 29 and windage adjustment knob 15.

In operation, the aperture member 19 is first grossly positioned along the axis 17 relative to the barrel, body, and windage members 29, 31, and 15 by loosening the set screw 33 (see FIG. 6) away from engagement with the elongated threaded portion 23 of the aperture member 19. In this loosened position of FIG. 6, the sighting portion 21 of the aperture member 19 can be gripped manually and the entire aperture member 19 can then be screwed or rotated about the axis 17 relative to the surrounding barrel member 29 (which is held against rotation as explained below). This rotation of the aperture member 19 about axis 17 will serve to grossly move it horizontally (i.e., left or right in FIG. 6) relative to the remaining members of the sight 1. Such rotation of the aperture member 19 is essentially done in multiples of whole turns (i.e., multiples of 360°) so that the aperture member 19 will always end up with its sighting portion 21 in the upright or vertical shooting position of FIGS. 3 and 4. Once the aperture member 19 has been grossly adjusted to the desired position, the set screw 33 is again tightened against the threaded portion 23 of the aperture member 19 (see FIG. 7). This prevents further movement of the aperture member 19 relative to the surrounding barrel member 29 not only about but also along the axis 17 (i.e., the aperture member 19 and barrel member 29 are secured together as one piece).

In the positions of FIGS. 6 and 7, the barrel member 29 is also prevented from moving rotationally about the axis 17 relative to the surrounding body member 31 by the same set screw 33. This is due to the fact that the stem 35 (see FIG. 8) of the set screw 33 extends radially outwardly of the axis 17 not only through the threaded bore 37 of the barrel member 29 but also outwardly through the unthreaded bore 39 of the body member 31. In this manner and with the set screw 33 in its tightened position of FIG. 7 with its tip abutting the threaded portion 23 of the aperture member 19, the concentric aperture, barrel, and body members 19, 29, and 31 are all prevented from moving relative to each other about the axis 17 by the single set screw 33 in the aligned bores 37 and 39. As illustrated, this is true regardless of whether the locking knob 25 is positioned against the body member 31 (FIG. 5) or spaced from the body member 31 (FIG. 7).

Continuing on and once the aperture member 19 has been grossly adjusted horizontally or left and right as discussed above and the set screw 33 has been tightened on it (FIG. 7), the windage adjustment or micrometer knob 15 is then screwed or rotated about the axis 17 to finely adjust the aperture member 19 and its sighting portion 21 horizontally. As shown, the knob 15 is mounted on the end section of the threaded portion 23 of the aperture member 19 which extends along the axis 17 through the bore 27 in the body member 31 and protrudes outwardly of the body member 31 on the left in FIG. 5. When adjusting the windage micrometer 15 at this stage, the sighting portion 21 is always maintained fixed in its upright or vertical shooting position of FIGS. 3 and 4. As set forth above, this is accomplished by the arrangement of the set screw 33 in the aligned bores 37 and 39 (see FIG. 8). That is, while the windage micrometer 15 moves the sighting portion 21 and attached barrel member 29 horizontally in Figure 7, the set screw 33 in the aligned bores 37 and 39 (FIG. 8) prevents the aperture member 19 and the barrel and body members 29 and 31 from rotating relative to each other about the axis 17.

At this point and with the aperture member 19 and its sighting portion 21 finely adjusted horizontally to the desired position (FIG. 7), the locking knob 25 is then tightened from the position of FIG. 7 to the locking position of FIGS. 5 and 8. In doing so, it draws the barrel member 29 (see FIG. 8) into frictional contact with the surrounding bore 27 of the body member 31. Such frictional contact serves to prevent movement of the aperture and barrel members 21 and 29 along the axis 17 relative to the body member 31. In this manner and with the common means of the single set screw 33, bores 37 and 39, and the locking knob 25, the concentric aperture, barrel, and body members 19, 29, and 31 of the sight 1 are thus prevented from moving relative to each other not only about the axis 17 but also along the axis 17. Consequently, the sighting portion 21 of the aperture member 19 is held tightly and securely in place for more accurate shooting.

Figure 10:
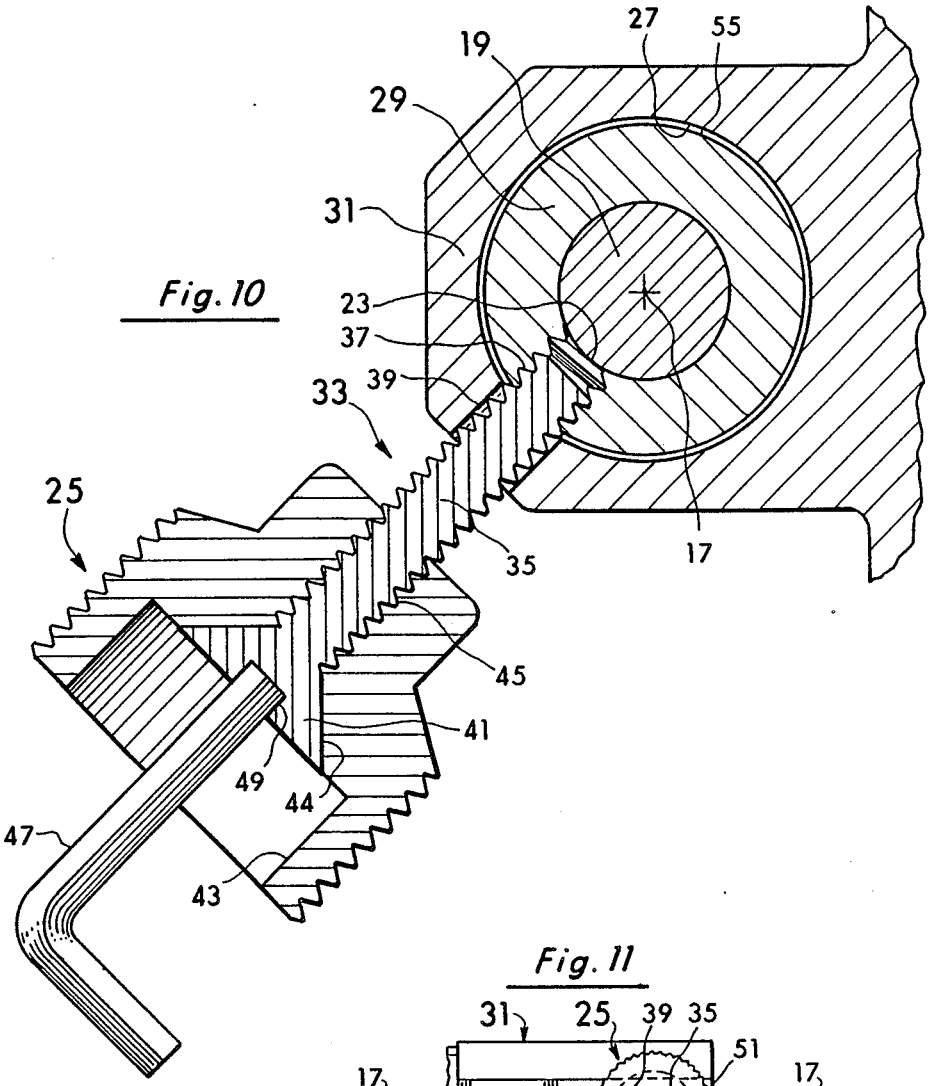
FIG. 10 is a view taken along line 10—10 of FIG. 6.

Referring to FIGS. 8–10, the set screw 33 as shown includes a stem portion 35 and a head portion 41 which together form an overall T-shape. Similarly, the bore of the locking knob 25 has a T-shape with a head portion at 43 and 44 and a stem portion 45. As best shown in FIGS. 5, 8, and 10, the set screw 33 and locking knob 25 can be operated independently of each other in a number of ways offering great flexibility to the archer. For example, the set screw 33 can be tightened against the threaded portion 23 of the aperture member 19 with the locking knob 25 spaced from the body member 29 (FIG. 7) or with the locking knob in its locking position (FIG. 5). The locking knob 25 and set screw 33 can also be manipulated to the position of FIGS. 6 and 10 with the tip of the set screw 33 disengaged from the threaded portion 23 of the aperture member 19 and with the locking knob also disengaged from the body member 31. The locking knob 25 is preferably adjusted manually while the set screw 33 is preferably operated by inserting a socket wrench 47 (see FIG. 10) through the accessible open end 43 of the locking knob 25 into the socket 49 (see FIGS. 8–10) in the head portion 41 of the set screw 33. This can also be accomplished by the equivalent structure of a slotted head and screwdriver. Consequently, in operation, the locking knob 25 can be released (FIG. 7) with the set screw 33 still engaged with the threaded portion 23 of the aperture member 21 and vice versa. Also, the locking knob 25 and set screw 33 can both be disengaged at the same time from the body and aperture members 31 and 19 respectively (FIG. 6) offering great flexibility of operation to the archer. Additionally, as shown, the locking knob 25 and set screw 33 are positioned at substantially the same location about and along the axis 17. They also extend substantially symmetrically about and along a common axis 50 (FIG. 8) that is substantially perpendicular to the axis 17. Consequently, they offer easy access and operation by the archer which can be particularly important when time is of the essence as in a timed shoot.

Figure 11:
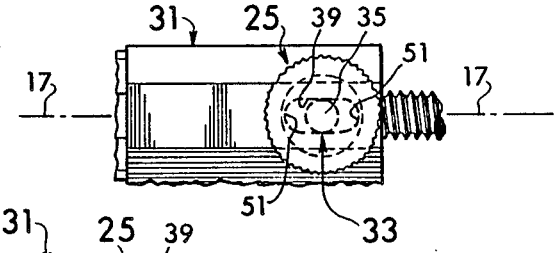
FIG. 11 is a view taken along line 11—11 of FIG. 7.
Figure 12:
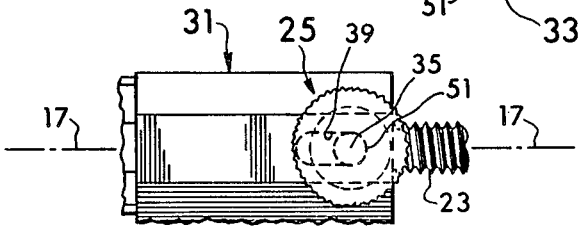
FIG. 12 is a view similar to FIG. 11.

The fine windage adjustment of the aperture member 19 by manipulating the micrometer 15 in FIG. 7 is limited by the ends of the bore 39. That is, as shown in FIG. 5 and more specifically in the enlarged views of FIGS. 11 and 12, the bore 39 through the body member 31 is elongated in a direction substantially parallel to the axis 17. Consequently, with the set screw 33 tightened on the threaded portion 23 of the aperture member 19 (FIG. 7), adjustment of the windage micrometer 15 will move the aperture member 21, barrel member 29, and set screw 33 along the axis 17 (e.g., to the right from FIG. 11 to FIG. 12). This, in turn, will move the stem 35 of the set screw 33 within the elongated bore 39 until the set screw stem 35 abuts one end 51 of bore 39 (FIG. 12). Among other things, this prevents the archer from adjusting the windage knob 15 too much to the extent that the barrel member 29 would be pushed out of the bore 27 in the body member 31. The presence of the predetermined limits defined by ends 51 also serves to remind the archer that he has gone too far either left or right and needs to make a gross adjustment of the aperture member 19 in the manner of FIG. 6.

With reference again to FIGS. 5, 8, and 10, the locking knob 25 in its locking position of FIGS. 5 and 8 draws the cylindrical barrel member 29 into frictional engagement with the cylindrical bore 27 of the body member 31. This frictional contact between the cylindrical outer surface 55 of the barrel member 29 and the cylindrical bore 27 of the body member 31 (see FIG. 5) is preferably line contact. Depending upon where the barrel member 29 is along axis 17 relative to the surrounding body member 31, the line contact will either be discontinuous along two co-linear portions on either side of the elongated bore 39 (FIG. 5) or it will be along a continuous line contact if the barrel and body members 29 and 31 are positioned as in FIG. 12. In either case, however, the frictional contact will be sufficient to firmly hold the barrel member 29 against movement relative to the surrounding body member 31 and, in turn, hold the sighting portion 21 of the aperture member 19 tightly and securely in place for more accurate shooting. As shown, the drawing of the barrel member 29 into frictional contact with the surrounding body member 31 will actually move the axis 17 and aperture member 29 very slightly (compare the relative positioning of members 29 and 31 and the gapping between cylindrical surfaces 27 and 55 in FIGS. 10 and 8). However, this slight movement (e.g., .001 to .002 inches) of the axis 17 and aperture member 19 during the locking procedure is far outweighed in importance by the secure lock that is ultimately obtained.

As discussed above, the elongated threaded portion 23 of the aperture member 19 (see FIG. 5) extends along the axis 17 away from the sighting portion 21 with the surrounding barrel member 29 extending about at least a section of the threaded portion 23. The body member 31, in turn, also extends about the axis 17 and about at least a section of the barrel member. Once the aperture member 19 is grossly adjusted for windage left or right (FIG. 6), the set screw 33 is then tightened on the threaded portion 23 of the aperture member 19 (FIG. 7) and the micrometer knob 15 adjusted to finely position the aperture member 19 horizontally. Once this has been done, the locking knob 25 (FIGS. 5 and 8) is thereafter tightened to draw the barrel member 29 in a direction along axis 50 (FIG. 8) substantially perpendicular to the axis 17 into frictional contact with the surrounding body member 31. The barrel member 29 as illustrated has a first threaded bore 30 extending along the axis 17 which receives the threaded portion 23 of the aperture member 19. The threads of 30 and 23 are mating wherein the aperture member 19 can be screwed or rotated about the axis 17 relative to the barrel member 29. The unthreaded bore 27 of the body member 31, in turn, also extends along the axis 17 about at least a section of the barrel member 29 and a section of the threaded portion 23 of the aperture member 19. The barrel member 29 as best seen in FIG. 8 has a second threaded bore 37 extending radially outwardly or substantially perpendicular to the axis 17. Similarly, the surrounding body member 31 has a second unthreaded bore 39 extending radially outwardly or substantially perpendicular to the axis 17. The bore 39 as discussed above is elongated in the direction parallel to the axis 17.

In use, the single set screw 33 can be screwed through aligned portions of the open-ended bores 37 and 39 in the barrel and body members 29 and 31 to a first position (FIG. 7) abutting the threaded portion 23 of the aperture member 19. In this position, set screw 33 prevents movement of the aperture member 21, barrel member 29, and body member 31 relative to each other about the axis 17. The same set screw in this first position (FIG. 7) protrudes outwardly of the body member 31 relative to the axis 17 wherein the locking knob 25 with its mating threads can be screwed onto the protruding portion of the set screw 33. Thereafter, the locking knob 25 can be selectively tightened on the set screw 33 in a first rotational direction (i.e., clockwise) to a locking position (FIG. 5) to draw the barrel member 29 into frictional contact with the body member 31. In this manner, the common means of set screw 33, bores 37 and 39, and locking knob 25 not only prevent movement or rotation of the aperture member 19, barrel member 29, and body member 31 relative to each other about the axis 17 but also prevent any relative movement among them along the axis 17.

The set screw 33 in use as shown in FIGS. 5–7 also serves to prevent the locking knob 25 from inadvertently falling off or becoming removed from the sight 1 and possibly becoming lost on the ground. That is, the locking knob 25 as illustrated in FIGS. 5–8 and 10 can only be unscrewed so far on the set screw 33 before the head 41 of the set screw 33 will abut the mating bore 44 in the locking knob 25 to prevent the locking knob 25 from being removed from set screw 33. This safety feature has great appeal to archers because if the locking knob 25 inadvertently becomes loose during shooting, it cannot unscrew itself far enough to fall off the sight 1 and possibly become lost. Also, the archer in use cannot inadvertently unscrew the locking knob 25 off of the set screw 33.

Figure 13:
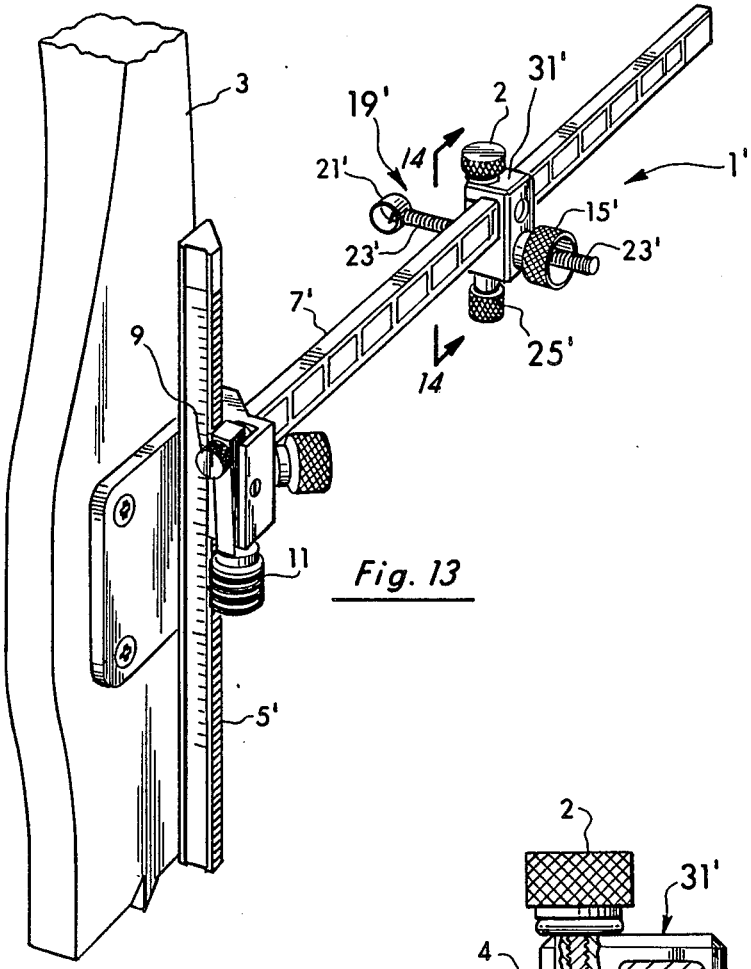
FIG. 13 is a perspective view of a second embodiment of the present invention.
Figure 14:
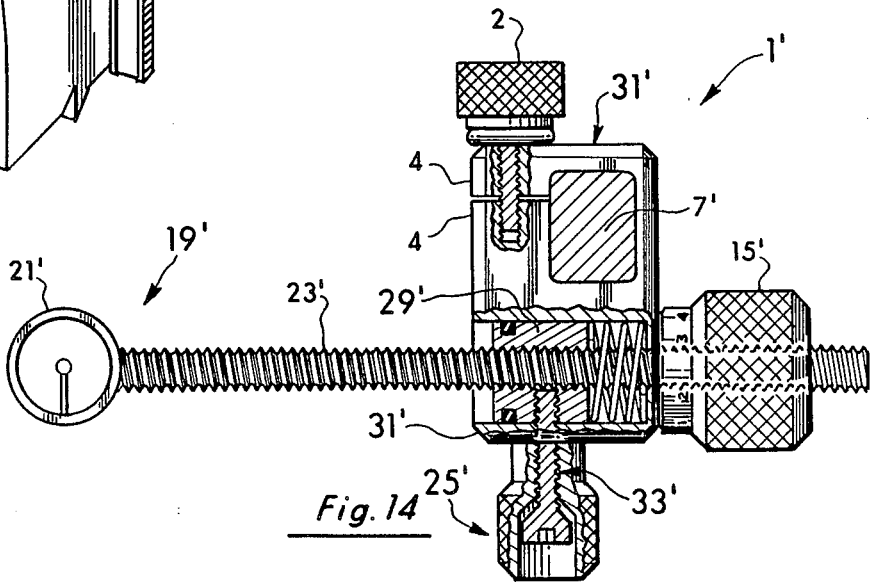
FIG. 14 is a partially cut-away view taken along line 14—14 of FIG. 13.

In FIGS. 13 and 14, a second embodiment of the invention is illustrated. In this embodiment, the aperture member 19' barrel member 29' and body member 31' are mounted on the extension bar 7' separate from the sight bar 5'. However, the windage locking apparatus is otherwise essentially the same as in the preferred embodiment of FIG. 112. As shown in FIG. 14, the sight 1' is slidably mounted on the extension bar 7' by a pincer arrangement wherein the knob 2 can be selectively tightened to draw the pincers 4 together to secure the sight body 31' on the extension bar 7'. With the sight body 31' secured to the extension bar 7' in the desired position, the set screw 33' can then be loosened as in FIG. 6 to grossly adjust the aperture member 19' after which the set screw 33' can be tightened as in FIG. 7 and the windage micrometer knob 15' manipulated to finely adjust the sighting portion 21'. Once adjusted, the aperture member 19' can be locked in place (see FIG. 14) by tightening the locking knob 25' to draw the barrel member 29' into frictional contact with the surrounding body member 31' in the manner of the preferred embodiment of FIGS. 1–12 as discussed above.

Although several embodiments of the present invention have been shown and described in detail, it is to be understood that various changes and modifications could be made to them without departing from the scope of the invention.

I claim:

1. In an archery bow sight having:

an aperture member with a sighting portion and an elongated threaded portion with said elongated threaded portion extending along a first axis away from the sighting portion, a barrel member extending about said first axis and about at least a section of the elongated threaded portion of said aperture member, said barrel member having a first threaded bore therethrough extending along said first axis, said first threaded bore of said barrel member and the threaded portion of said aperture member having mating threads wherein the threaded portion of said aperture member can be screwed relative to said barrel member about said first axis into the first threaded bore of said barrel member, and a body member extending about said first axis, said body member having a first bore therethrough extending along said first axis, said body member also extending about at least a section of said barrel member and said section of the threaded portion of said aperture member, the improvement including:

common means for preventing movement of said aperture member, barrel member, and body member relative to each other about and along said first axis, said common means including a single, threaded set screw, a second bore in said body member, a second threaded bore in said barrel member, and a locking knob with a threaded bore, said second bore in said body member and said second threaded bore in said barrel member extending substantially radially outwardly of said first axis and having at least portions thereof aligned with each other to receive said set screw therein, the threads of said set screw, second bore in said barrel member, and bore of said locking knob all mating wherein said single set screw can be screwed through said aligned portions of said second bores in said body and barrel members to a first position abutting the threaded portion of said aperture member and extending through said aligned portions of said second bores of said barrel and body members to prevent movement of said aperture member, barrel member, and body member relative to each other about said first axis, said set screw in said first position protruding outwardly of said body member relative to said first axis wherein said locking knob can be screwed onto the portion of the set screw protruding outwardly of the body member and selectively tightened thereon in a first rotational direction to a locking position to draw said barrel member into frictional contact with said body member to prevent movement of said barrel member and aperture member along said first axis relative to said body member.

2. The improvement of claim 1 wherein said set screw and said locking knob extend about and along a common axis.

3. The improvement of claim 2 wherein said common axis is substantially perpendicular to said first axis.

4. The improvement of claim 1 further including means for preventing said locking knob from being removed from said set screw.

5. The improvement of claim 1 wherein said set screw is substantially T-shaped with said T-shape having a head and stem and the bore of said locking knob is correspondingly T-shaped with a head and stem wherein said locking knob can be selectively loosened on said set screw by rotating said locking knob in a rotational direction opposite said first rotational direction away from said locking position until the head of the T-shape of the set screw abuts the head of the T-shape of the bore of the locking knob to prevent said locking knob from being removed from said set screw.

6. The improvement of claim 5 wherein the portion of the set screw protruding outwardly of said body member has a socket therein and the head of the bore of the locking knob is open ended wherein said socket is accessible through the head of the bore of said locking knob.

7. The improvement of claim 1 wherein the bore of the locking knob is open ended and the portion of the set screw protruding outwardly of said body member has a socket therein wherein said socket is accessible through the bore of said locking knob.

8. The improvement of claim 1 wherein the second bore in said body member receiving said set screw is elongated in a direction substantially parallel to the first axis.

9. The improvement of claim 1 further including means for limiting the relative movement of the barrel member along the first axis relative to the body member to between first and second predetermined limits.

10. The improvement of claim 9 wherein said limiting means includes said set screw and said second bore of said body member wherein said second bore of said body member receiving said set screw is elongated in a direction substantially parallel to the first axis and as said barrel and body members are moved relative to each other along the first axis, said set screw abuts against one end of the elongated bore in one relative positioning of the barrel and body members to define the first predetermined limit and abuts against the other end of the elongated bore in another relative positioning of the barrel and body members to define the second predetermined limit.

11. The improvement of claim 1 further including an adjustment knob with a threaded bore with the threads thereof mating with the threads of the threaded portion of said aperture member wherein an end section of said threaded portion of said aperture member can be positioned to protrude through the first bore of said body member and outwardly of said body member along said first axis so that said adjustment knob can be screwed on the protruding portion of the threaded portion of said aperture member to selectively move said barrel member and said aperture member axially along said first axis relative to said body member when said locking knob is away from said locking position and said locking knob can be subsequently rotated to the locking position to secure the aperture member, barrel member, and body member in place once the adjustment knob has been adjusted as desired.

12. The improvement of claim 1 further including means for selectively adjusting the position of the aperture member and barrel member along the first axis relative to the body member when the locking knob is away from the locking position.

13. An archery bow sight including:

an aperture member having a sighting portion and an elongated threaded portion with said elongated threaded portion extending along a first axis away from the sighting portion, a barrel member extending about said first axis and about at least a section of the threaded portion of said aperture member, said barrel member having a first threaded bore therethrough extending along said first axis, said first threaded bore of said barrel member and said threaded portion of said aperture member having mating threads wherein said threaded portion of said aperture member can be screwed into said threaded bore of said barrel member, a body member extending about said first axis and about at least a section of said barrel member and about said section of the threaded portion of said aperture member, rotation preventing means including first means for selectively preventing rotation of said aperture member about said first axis relative to said barrel member and second means for preventing rotation of said barrel member about said first axis relative to said body member, said first and second means including a common, single set screw with threads, a second threaded bore in said barrel member, and a second bore in said body member, said second bores of said barrel and body members being open ended and having at least portions thereof aligned to receive said set screw therein, the threads of said set screw and said second bore of said barrel member mating wherein said set screw can be screwed through said aligned portions of said second bores of said barrel and body members to a first position abutting the threaded portion of said aperture member to prevent rotation of said aperture member about said first axis relative to said barrel member, said set screw in said first position extending through the second bore of said body member to prevent rotation of said barrel member about said first axis relative to said body member, and locking means for selectively preventing movement of said barrel member along said first axis relative to said body member, said locking means including a locking knob having a threaded bore with threads mating with the threads of said set screw, said set screw in said first position protruding outwardly of said body member through the second bore of said body member wherein said locking knob can be screwed onto the portion of the set screw protruding outwardly of the body member and selectively tightened thereon in a first rotational direction to a locking position to draw said barrel member into frictional contact with said body member to prevent movement of said barrel member along said first axis relative to said body member.

14. The bow sight of claim 13 wherein said set screw and said locking knob extend about and along a common axis.

15. The bow sight of claim 14 wherein said common axis is substantially perpendicular to said first axis.

16. The bow sight of claim 13 further including means for preventing said locking knob from being removed from said set screw.

17. The bow sight of claim 13 wherein said set screw is substantially T-shaped with said T-shape having a head and stem and the bore of said locking knob is correspondingly T-shaped with a head and stem wherein said locking knob can be selectively loosened on said set screw by rotating said locking knob in a rotational direction opposite said first rotational direction away from said locking position until the head of the T-shape of the set screw abuts the head of the T-shape of the bore of the locking knob to prevent said locking knob from being removed from said set screw.

18. The improvement of claim 17 wherein the portion of the set screw protruding outwardly of said body member has a socket therein and the head of the bore of the locking knob is open ended wherein said socket is accessible through the head of the bore of said locking knob.

19. The improvement of claim 13 wherein the bore of the locking knob is open ended and the portion of the set screw protruding outwardly of said body member has a socket therein wherein said socket is accessible through the bore of said locking knob.

* * * * *